US011026016B2

(12) United States Patent
Sahyoun

(10) Patent No.: US 11,026,016 B2
(45) Date of Patent: Jun. 1, 2021

(54) TUBULAR PASSIVE ACOUSTIC RADIATOR MODULE

(71) Applicant: Joseph Yaacoub Sahyoun, Redwood City, CA (US)

(72) Inventor: Joseph Yaacoub Sahyoun, Redwood City, CA (US)

( * ) Notice: Subject to any disclaimer, the term of this patent is extended or adjusted under 35 U.S.C. 154(b) by 147 days.

(21) Appl. No.: 16/420,164

(22) Filed: May 23, 2019

(65) Prior Publication Data

US 2019/0281382 A1 Sep. 12, 2019

Related U.S. Application Data

(62) Division of application No. 15/165,379, filed on May 26, 2016, now Pat. No. 10,349,166.

(60) Provisional application No. 62/167,713, filed on May 28, 2015.

(51) Int. Cl.
*H04R 1/28* (2006.01)
*H04R 1/22* (2006.01)

(52) U.S. Cl.
CPC ..... *H04R 1/2834* (2013.01); *H04R 1/2826* (2013.01); *H04R 1/227* (2013.01); *H04R 1/2857* (2013.01); *H04R 2205/021* (2013.01)

(58) Field of Classification Search
CPC .... H04R 1/2834; H04R 1/2826; H04R 1/227; H04R 1/2857; H04R 2205/021
USPC ..... 381/345
See application file for complete search history.

(56) References Cited

U.S. PATENT DOCUMENTS 6,044,925 A * 4/2000 Sahyoun ..... H04R 1/2834 181/157
6,457,548 B1 * 10/2002 D'Hoogh ..... H04R 1/2834 181/156
2004/0131219 A1 * 7/2004 Polk, Jr. ..... H04R 1/2826 381/345
2005/0018868 A1 * 1/2005 Chick ..... H04R 1/2834 381/349
2007/0092096 A1 * 4/2007 Litovsky ..... H04R 1/2873 381/349
2008/0205682 A1 * 8/2008 Jenkins ..... H04R 1/025 381/349
2009/0245561 A1 * 10/2009 Litovsky ..... H04R 1/2834 381/345
2010/0027815 A1 * 2/2010 Burge ..... H04R 1/2834 381/182

(Continued)

*Primary Examiner* — Sean H Nguyen

(57) ABSTRACT

A low cost/high efficiency passive radiator module component includes: a tubular ported cavity structure adapted for placement inside an acoustic enclosure with a port communicating out of the acoustic enclosure and one or more pairs of passive radiators symmetrically oriented and supported on opposing side walls of the ported cavity each having a predetermined or tuned mass distribution, stiff acoustic radiating diaphragm surfaces, and spaced apart inner and outer suspensions configured to suppress diaphragm wobble that induces each pair to symmetrically vibrate inertially responsive to variable sound pressure pulses originating from an active acoustic radiator within the acoustic enclosure. Different variable acoustic pressure pulses may be detected inside and outside the ported cavity; the constricting horn connecting to the ported cavity from outside may be tuned by horn loading to achieve a desired effect.

18 Claims, 20 Drawing Sheets

(56) References Cited

U.S. PATENT DOCUMENTS

2013/0213628 A1* 8/2013 Litovsky ..... H04R 1/2834
165/185
2014/0003645 A1* 1/2014 Silver ..... H04R 1/288
381/351

* cited by examiner

TUBULAR PASSIVE ACOUSTIC RADIATOR MODULE

CROSS REFERENCE TO RELATED APPLICATION

This application is a divisional application of U.S. application Ser. No. 15/165,379 entitled: "Passive Acoustic Radiator Module," filed May 26, 2016 which was a continuation-in-part application of U.S. Provisional Patent Application Ser. No. 62/167,713 filed on May 28, 2015, by Joseph Y. Sahyoun.

BACKGROUND OF THE INVENTION

Field of the Invention

The present invention relates generally to full range speaker, woofer and subwoofer acoustic enclosures incorporating an woofer or subwoofer and passive acoustic radiator elements having resonance frequencies that range from 200 Hz to below audible levels (10 Hz) and, in particular, to mass-loaded, symmetrically positioned passive radiator elements in one or more horn loaded modules in the speaker enclosure to provide improved and enhanced audible viscerally-sensed bass frequency output from any woofer enclosure.

Description of the Prior Art

Ported acoustic enclosures driven by active acoustic radiators, e.g. a woofer speaker, provide louder (greater amplitude) output sound than sealed acoustic enclosures driven by similar active acoustic radiators because the air mass moving within the port provides greater sound pressure levels (SPL) at the tuning or resonant frequency of the driving woofer speaker. However, at output sound frequencies different than the tuning frequency, the configuration of ported enclosures cause cancelation of part of the SPL produced by the woofer speaker. This is due to a phase shift in the frequency of the sound between the frequency generated by the woofer's and its moving air mass and the sound frequency present within the ports and their moving masses, due to the SPL gradient which is highest at the surface of the sound generator (the woofer speaker) and the ambient SPL outside the speaker enclosure. Woofers typically have narrow bandwidths filtering to achieve maximum SPL in a range between 30 Hz to 80 Hz.

Passive radiators have been used in woofer and subwoofer enclosures for many years, principally to improve the quantity of and quality of bass frequencies generated by woofer and subwoofer acoustic enclosures. From a design or analytical standpoint passive radiators behave are modelled exactly like a port in an acoustic enclosure, providing an inertial mass equivalent to an air mass of a port to boost the response of an active radiator (woofer) driving the enclosure in a resonance frequency range, and running out of phase above and below that resonance frequency range.

Prior art designs of woofer and subwoofer acoustic enclosures augmented with passive radiators have not considered spring resistance noncompliance, i.e. kinetic energy-in ($K_{in}$) vs. kinetic energy-out ($K_{out}$). For example, air volume (number of molecules) within an acoustic enclosure is fixed and volumetric distortion of a wall (or limit) causes the contained air mass to essentially function as an elastic air spring coupling the active woofer and the passive radiator mounted within the enclosure. To get work from the passive radiator, the woofer, as the driving radiator, elastically vibrates in and out (creating a localized volumetric change within the closed enclosure) compressing the air (spring) within the acoustic enclosure that in turn creates a pressure force to drive elastically deformable portions (surfaces) of the passive radiator in an in and out vibrational frequency which is typically lower than the frequency of the driving radiator, the lower frequency of the passive radiator is attributable to the time delay in the motion of the inertial mass of the passive radiator as the pressure waves travel through the air (spring) within the enclosure. Sound pressure levels (SPL) inside and outside the acoustic enclosure maximize when the vibrational motion of the moving elements of the active woofer move out and in and the passive radiator move in and out at the same time, i.e., harmonically. Since air is trapped in the acoustic enclosure, the in and out vibration of the passive radiator impacts the centering, relative to a top plate, of the voice coil of the active woofer and harmonic distortion occurs when the spring constants of the in and out strokes are different. Also, while passive radiators inertially react to the air pressure vibrations of the active woofer, they vibrate at a lower frequency.

In his U.S. Pat. No. 6,044,925, Sahyoun, U.S. Pat. No. 6,460,651, Sahyoun U.S. Pat. No. 6,626,263, Sahyoun U.S. Pat. No. 7,318,496, Sahyoun U.S. Pat. No. 7,360,626 Sahyoun and U.S. Pat. No. 8,204,269, Sahyoun, the Applicant Sahyoun teaches a necessity for, and advantages of symmetrically loaded suspension systems for both active and passive acoustic radiator systems characterized as Symmetrically Loaded Audio Passive Systems or SLAPS.

Prior disclosures by the inventor herein recognized that the normal audio spectrum detectable by the human ear ranges from 25 Hz to 12 kHz. That the transition between 20 to 25 Hz is sub audible/audible and that if a passive radiator is tuned to below 20 Hz, then the phase shift (group delay) inherent in passive tuned enclosure containing such a passive radiator will be below audible. Furthermore, when using passive radiators having certain compliance values the moving elements in the passive and the active radiators can be made to vibrate 180° out of phase so that the mass of combined moving elements in the passive and active radiators generate vibrations that likely to be viscerally sensed by a listener. (Compliance or Cms is measured in meters per Newton. Cms is the force exerted by the mechanical suspension of the speaker. It is simply a measurement of its stiffness. Considering stiffness (Cms), in conjunction with the Q parameters (related to the control of a transducer's suspension when it reaches the resonant frequency gives rise to the kind of subjective decisions made by car manufacturers when tuning cars between comfort to carry the president and precision to go racing. Think of the peaks and valleys of audio signals like a road surface then consider that the ideal speaker suspension is like car suspension that can traverse the rockiest terrain with race-car precision and sensitivity at the speed of a fighter plane. It's quite a challenge because focusing on any one discipline tends to have a detrimental effect on the others.) For example, the harmonic frequency of an "E note" of a bass guitar is about 41.2 Hz at harmonic. Depending how far a listener is from the source, he or she will viscerally sense resonance frequencies as low as 15 Hz from a source that has a fundamental source frequency of 41.2 Hz. The generation of such sub audible mechanical vibrations effectively brings a listener to center stage providing sensation of audible frequencies combined with a nice blend of low frequency vibrations below audible which can likely be detected by skin and other nerve ending detectors (sensors) of the human body.

In addition a primary factor compromising synchronous and ideal resonant frequency generation of a passive radiator in acoustic systems is group delay, i.e. the frequency/time response of the system. A slower passive radiator response muddies bass response of an acoustic cavity. Summarizing, prior art originating with the inventor herein teaches that acoustic systems that include a single passive radiator can be tuned to below audible frequencies, for shifting the group delay response to a frequency range below the human hearing threshold.

However, in acoustic enclosures where two or more passive radiators are driven by a common active or a common monaural driven active radiator, other parameters effectively preclude a true bass audio response. In particular, mounting passive radiator modules with two or passive radiators acoustically coupling the interior volume of an acoustic enclosure with "a cavity located inside the acoustic enclosure having an opening to outside the acoustic enclosure", i.e., a ported cavity as taught in U.S. Pat. No. 7,133,533, Chick, et al. and related U.S. Pat. No. 8,031,896, Chick, et al. & U.S. Pat. No. 8,594,358, Litovsky et al. are not easily tuned to provide an acceptable audible bass response much less a nuanced blend of sub-audibly sensed vibrations.

In particular, passive radiators never have identical compliance values, nor do they experience the same environmental loading in an acoustic enclosure, hence they have different resonance frequencies, one for each passive radiator and one for the active driving radiator. Audio sweeps of frequency vs. impedance in acoustic systems having a plurality of commonly driven passive radiators produce more than one peak impedance values, one for the active or driving radiator (normal) and one for each passive radiator. Such systems also have additional peak impedances when plotting SPL vs frequency. Phase shift typically is in the valley between two peaks. These phase shifts are not correctable and further degrade the quality of any bass response/sound generated by such systems. Further, it is virtually impossible to decouple the responses of commonly driven passive radiators mounted within an acoustic enclosure coupling acoustic energy into a common cavity located inside the acoustic enclosure as taught by Chick, et al. and Litovsky et al. Subtle sound pressure instabilities which develop in such systems both within the common acoustic enclosure and within the ported cavity that cause the surfaces of the passive radiators to wobble, as the part of the radiator is closer to the mouth (output port) experiences higher forces than the part farther away from the mouth (output port), causing phase delineation that effectively degrades the bass response. (See also the discussion in the specifications of the respective cited Chick, et al. & Litovsky et al patents relative to FIGS. 3A, 3B and FIG. 4, described therein.) Baffle and barrier structures ostensibly designed to isolate the response of two or more commonly driven passive radiators coupling acoustic energy into a common ported cavity tend to induce frequency permutations peculiar to the structure of the baffle or barrier. Finally, a point seemingly ignored by Chick, et al. and Litovsky et al. is that ported cavities within such acoustic enclosures inherently couple the responses of driven passive radiators radiating acoustic vibrations into the ported cavity.

Prior art acoustic enclosures, which employ one or more passive radiator that have a vibrating surface which seals between and is in communication with an acoustic enclosure on one side and a space connected by a passage through a mouth that opening to atmospheric pressure outside the sealed acoustic enclosure; will wobble generally about an axis 90 degree to the central axis of the mouth. Such wobble generates audible distortion and potential reduction in the excursion (amplitude) of the passive radiators. Wobble is visible, and common, in all prior art where the stiff part of the passive radiator have a center of gravity that is fixed; in the middle of the cone or the radiating surface.

SUMMARY OF THE INVENTION

Embodiments according to this invention can be used in any sealed enclosure with an active radiating surface. Just by mounting a module according to this invention into one of the walls, the active radiating surface will charge the air spring which pushes on the passive radiator surface thereafter. Furthermore, embodiments according to this invention allow the active module to be distant from and embedded internally (buried) within the enclosure and to use a duct of the module to transport and guide the pressure wave from the passive radiators to an opening in one of the walls of the enclosure to atmospheric pressure surrounding the enclosure. This module can also be used in home audio as a retrofit. Users can use the space between ceiling joists to mount a module according to the invention in the ceiling (or floor). The woofer would then also be mounted between the ceiling or floor joists so that it drives the passive radiator using pressure waves in the closed speaker enclosure space bounded at least partially by the ceiling or floor joists. A method according to this invention provides mounting an active driver with a passive radiator on the same module and then fitting the module between the ceiling or floor joists of a house. This installation method allows a homeowner to enjoy enhanced bass sound from otherwise wasted space.

Embodiments according to the current invention are extensions of the previous work of the inventor herein with passive radiators.

A low cost/high efficiency passive radiator module component includes: a ported cavity structure adapted for placement inside an acoustic enclosure with a port communicating out of the acoustic enclosure; and one or more essentially congruent pairs of passive radiators symmetrically oriented and supported on opposing side walls of the ported cavity each having a predetermined mass distribution, stiff acoustic radiating diaphragm surfaces and spaced apart inner suspensions/outer suspensions configured for suppressing wobble that induces each pair to symmetrically vibrate inertially responsive to variable acoustic pressure pulses radiated by an active acoustic radiator within the acoustic enclosure for radiating different variable acoustic pressure pulses inside and outside the ported cavity.

Another embodiment of a high efficiency passive radiator module component includes: a horn structure having a throat section inside an acoustic enclosure and mouth section communicating out of the acoustic enclosure; and one or more essentially congruent pairs of passive radiators symmetrically oriented and supported on opposing side walls of the horn structure each having a predetermined mass distribution that induces each pair to symmetrically vibrate inertially responsive to variable acoustic pressure pulses radiated by an active acoustic radiator within the acoustic enclosure for radiating different variable acoustic pressure pulses inside and outside the ported cavity.

Low cost/high efficiency passive radiator module components include horn loading techniques that can be added to any acoustic enclosure that allow the end user to change the magnitude and location of the center of gravity of the mass moving in one or more passive radiators based on their applications and need. A system according to the invention can have the air mass between the moving surface(s) of the one or more passive radiators in communication with (fire) into (and through) a horn loaded tunnel which compounds the bass and lower the resonance frequency even further.

In horn-loaded modules that do not use passive radiators that are not symmetrically in communication with atmospheric pressure using a symmetrical suspension, wobble emanates from a nonlinear sound pressure differential that favors the half of (portion of) the vibrating surface area of the passive radiator that is closer to (a shorter distance from) the portion of the acoustic passage in communication with atmospheric pressure. Such wobble causes acoustic distortion as well as a reduction in the useful Xmax of the passive radiator. By adding an inertial mass, IM to a stiff acoustic radiating diaphragm of the passive (this mass is positioned to offset the center of gravity of the moving diaphragm a certain predetermined distance in the direction along the axis of the acoustic passage in communication with atmospheric pressure toward the mouth open to atmosphere, the half side of the passive radiator face (vibrating surface) proximate to the mouth is equal to ½ the inertial air mass loading, IAML/2, at the mouth, so that the location of the center of gravity is offset from the geometric center of the vibrating surface of the radiating diaphragm, so that such offset of the center of gravity acts to equalize the offset load created by the air mass moving only to and from in one lateral direction (side) of the passive radiator in communication with the mouth to thereby dampen a laterally induced wobble created by the air mass load coming and emanating in only one lateral direction.

In another embodiment a passive radiator module component has a tubular (e.g., cylindrical) configuration with a hemispherical end cap sealing the end of the tube to reduce turbulence in the airflow generated. When installed in an acoustical enclosure, the passive radiator module component, having the tube will radiate sound within the tube to the outside of the acoustic enclosure based on the expanding/collapsing walls (one or more passively vibrating surfaces) of the module. Further, a through acoustic enclosure, a tube having its internal surface open to atmosphere at both ends and sealing the openings in the acoustic enclosure through which the tube extends and having its external surface exposed to the sealed space of the acoustic enclosure, tubular configuration (arrangement) can be utilized. Such tubular configuration passive radiator arrangements can replace a standard open ended tubular port with a one end closed or a through tube sealed between the acoustically sealed enclosure and the atmospheric pressure that radiates sound by moving partial arc cylindrically shape matching surface on the side of the tube such that a curved geometry of the suspensions of the moving partial arc cylindrically shape matching surfaces damps wobble of the acoustically radiating surfaces of the passive. The tubular passive radiator module component can have a hexahedral shape.

Another feature of a passive radiator module component is that it permits an isolation plane between the two or more radiating surfaces to assist in mitigating frequency phase delineation due to rear wave refection in the (acoustic enclosure/module).

In particular, passive radiators are never identical in compliance or environmental loading. Each passive acoustic radiator in a common acoustic enclosure inherently has different resonance frequency. A speaker box with one radiating surface, a woofer, has one pole, when having two radiating surfaces, two poles, and three surfaces, three poles. An audio sweep plotting frequencies vs. impedance, produces peak impedances that correlate to the driving active acoustic radiator (normal) and one for each passive radiator in the in the enclosure. Such systems have additional poles (radiating surfaces or directions) that produce phase shifts between the peaks that compromise the quality of the frequency response of the system. Such phase shifts are not correctable. Hence adding an isolation plane between the two or more radiating surfaces reduces this action-reaction effect.

Another advantage of the described high efficiency passive radiator module component is that passive radiators with different masses are possible, which may be useful in mechanically vibrating systems, but generally consistent with improved audio quality and amplitude as achieved and discussed herein.

BRIEF DESCRIPTION OF THE DRAWINGS

FIG. 13A shows a cross section of an acoustic enclosure allowing illustrating the assembly method of the port module 198A into an enclosure.

DETAILED DESCRIPTION

Figure 1:
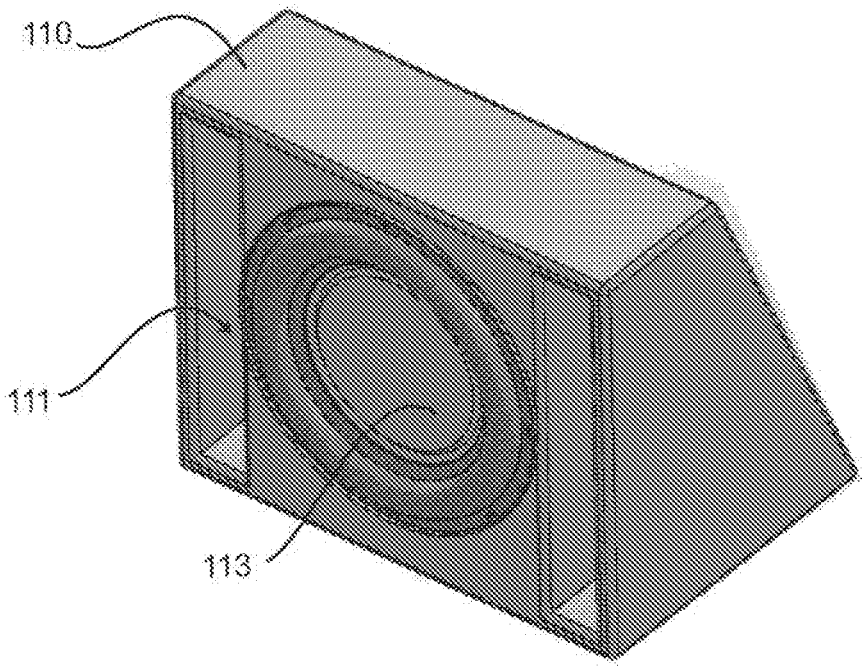
Fig-1( PRIOR ART)
FIGS. 1 and 1A shows a perspective and cutaway view of a shows prior art, front firing acoustic enclosure 110 (speaker) with two symmetrical front ports (vents) 111 venting on opposite sides of an acoustic transducer 113.
Figure 1A:
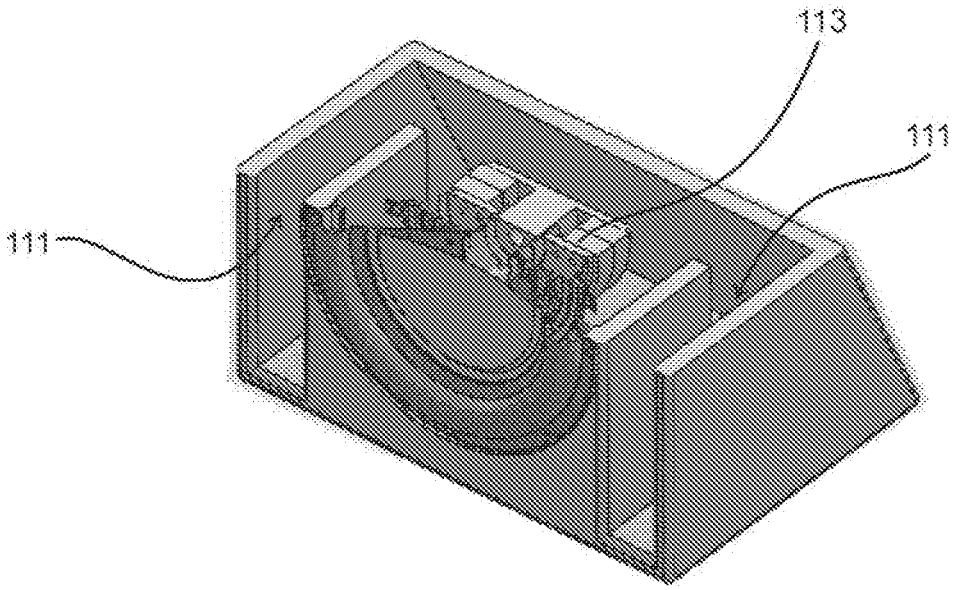
Fig-1A ( PRIOR ART)

FIGS. 1 and 1A show a perspective and cutaway view of a prior art, front firing acoustic enclosure 110 (speaker) with two symmetrical front ports (vents) 111 venting on opposite sides of an acoustic transducer 113. The acoustic transducer 113 acoustically pressurizes the enclosure. The area and length of the ports 111 determine and establish the moving air mass, i.e., air volume multiplied by air density, that when driven by acoustic pressure pulses generated by the acoustic transducer 113 tunes the enclosure 110 to a desired frequency. Such port tuning is a problem in that it allows voices (the voice of a singer (high frequency sound pressure level) will leak through the port, the active radiator support hole, and will sound like echo which is not desirable) leak through the ports 111. In subwoofer applications, voice leaks cause distortions. Another disadvantage of this prior art configuration is size. Enclosures that are tuned for low frequencies, e.g., 20 Hz, require a three foot long port to be incorporated (configured) together with an acoustic enclosure volume of 1 cubic foot.

Figure 2A:
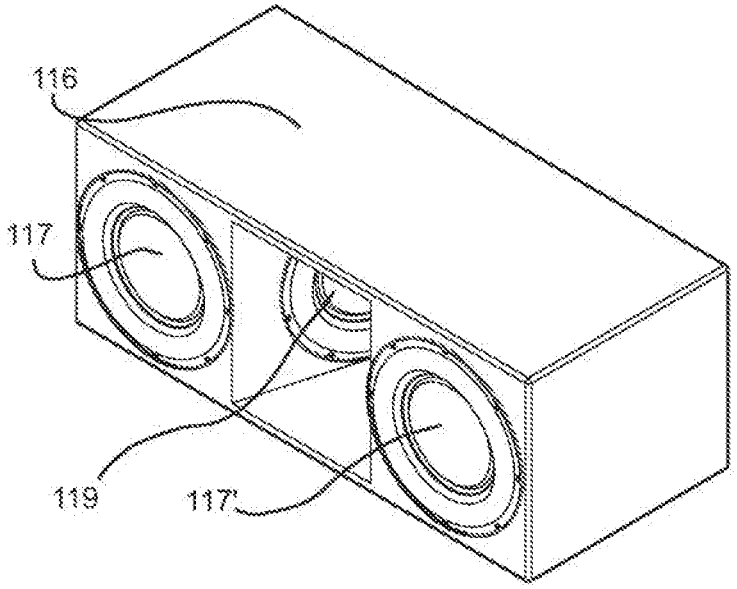
Fig- 2A (PRIOR ART)
FIGS. 2A-2C, show perspective, front and top cross sectional views of an acoustic speaker system 116 dating back to 1989 with two woofers 117,117' firing into (driving) a common enclosure with two horn loaded speakers 119 &119'.
Figure 2B:
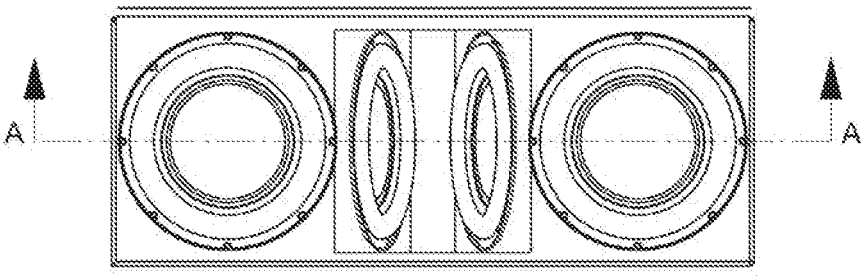
Fig- 2B (PRIOR ART)
Figure 2C:
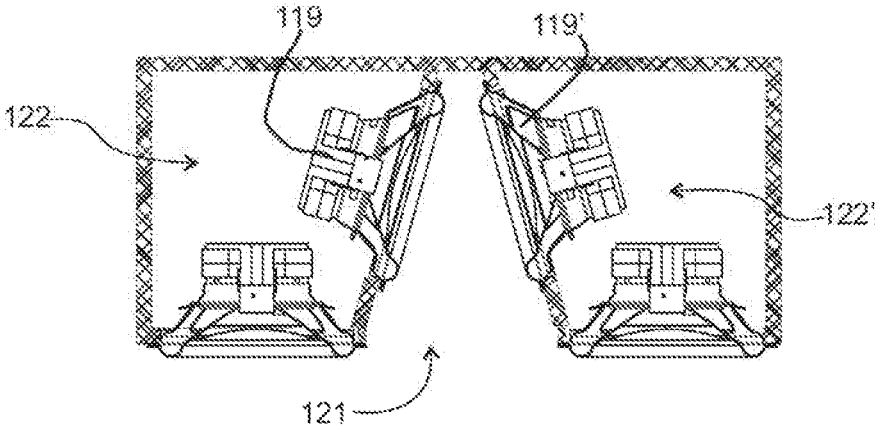
Fig- 2C (PRIOR ART)

FIGS. 2A-2C, show perspective, front and top cross sectional views of an acoustic speaker system 116 dating back to 1989 with two woofers 117, 117' firing into (driving) a common enclosure with two horn loaded speakers 119 & 119'. The horn loaded speakers have slightly different tuning frequencies since both the woofers 117 & 117', and the horn loaded speakers 119 & 119' react to the acoustic pressure environment within the enclosure as they load differently, resulting in 2 different resonance frequencies, one for woofer pair 117 & 117', and one for the horn loaded pair 119 & 119'. The configuration of acoustic speaker system 116 with an active pairs of speakers 119 & 119' mounted in a symmetric horn loading design configuration 121 (FIG. 2C) also allows for generation of lower harmonic frequencies. In particular, by suspending an active pair of speakers having inner and outer suspensions which eliminate wobble due to loading offset, allows for a resonance frequency that is significantly different than that of the two front woofers 117 & 117' [See U.S. Pat. No. 6,044,925.]

Figure 3A:
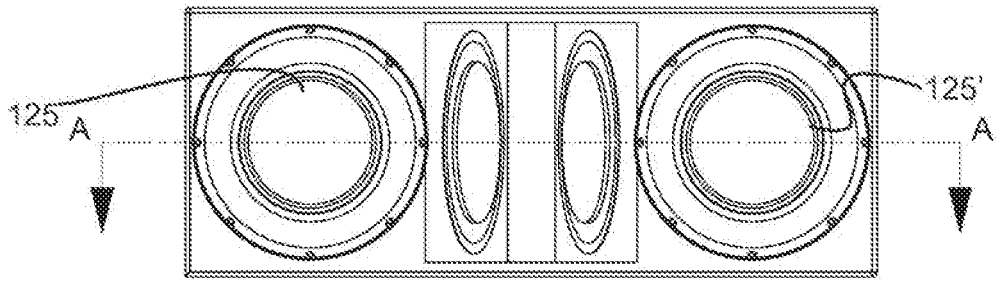
Fig-3A (PRIOR ART)
FIGS. 3A and 3B shows front and cross sectional views of an embodiment of a prior art speaker system with two active woofers 125 &, 125' driving a common acoustic enclosure with two passive acoustic radiators (PARs) 127 &, 127' suspended within the enclosure oriented in a horn loading configuration.
Figure 3B:
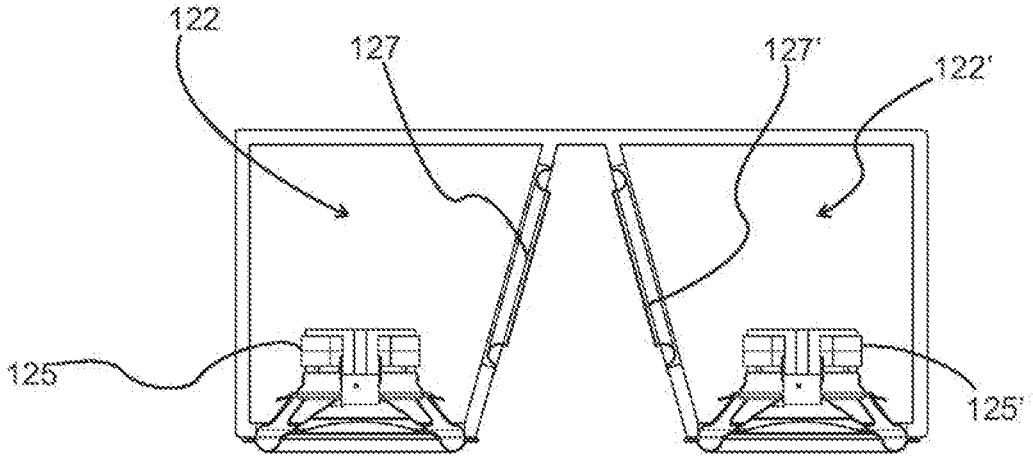
Fig-3B (PRIOR ART)

FIGS. 3A and 3B show front and cross sectional views of an embodiment of a prior art speaker system with two active woofers 125, 125' driving a common acoustic enclosure with two passive acoustic radiators (PARs) 127, 127' suspended within the enclosure oriented in a horn loading configuration. Both the active woofers and the PARs are symmetrically loaded. The active woofers 125, 125' drive an acoustic air spring in the enclosure transferring energy to the PARs 127, 127' based on the ratio of the mass of the PARs and to air mass of the acoustic enclosure. FIG. 3B shows a section A-A cut through the centerline of FIG. 3A. The left side of the enclosure is mirror image to the right side. At their resonance frequency, the PARs will have long excursion inducing a large wobble through the center lines of the PARs extending from the back of the enclosure to the front mouth of the horn opening.

Figure 3C:
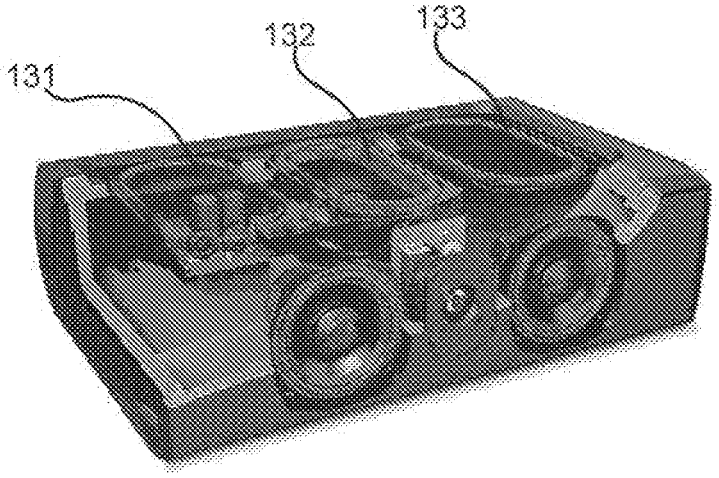
Fig-3C (PRIOR ART)
FIG. 3C shows a cutaway image of an inverted (up-side-down) full range speaker configuration with a tweeter located between two midrange speakers on an acoustic panel enclosure radiating outward to listeners (facing the viewer in this drawing).

FIG. 3C shows a cutaway image of an inverted (up-side-down) full range speaker configuration with a tweeter located between two midrange speakers on an acoustic panel enclosure radiating outward to listeners (facing the viewer in this drawing). A woofer 132 drives separate acoustic enclosure behind the panel enclosure coupling with two PARs 131, 133 that produces lower harmonics due to an increase in front pressure (sound pressure directed away from the radiator along its central axis).

Figure 4A:
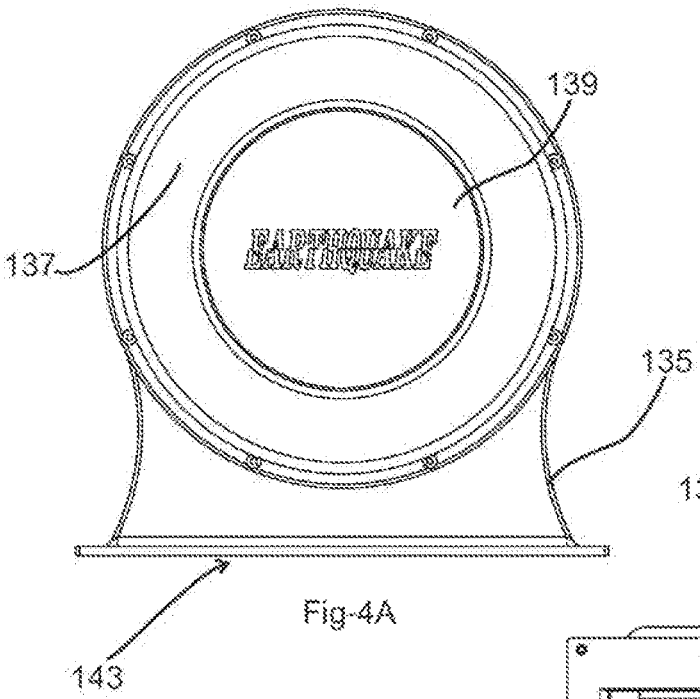
FIG. 4A is a top plan view of a design for a passive acoustic radiator module [PARM] 135 adapted for mounting in an acoustic enclosure that includes a pair of passive radiators symmetrically oriented and supported on opposing side walls of a ported cavity 143 each having outer and inner flexible surrounds 137 &, 141 and a stiff cones 139 for radiating different variable acoustic pressure pulses inside and outside the ported cavity proportionate to the excursion and diameter of the passive radiators.

FIG. 4A is a plan view of a passive acoustic radiator module [PARM] 135 adapted for mounting in an acoustic enclosure that includes a pair of passive radiators symmetrically oriented and supported on opposing side walls of a ported cavity 143 each having outer and inner flexible surrounds 137, 141 and a stiff cones 139 for radiating different variable acoustic pressure pulses inside and outside the ported cavity proportionate to the excursion and diameter of the passive radiators. Port structural supporting leaves 143' provide structural support and air guidance across the gap of the port opening (cavity) 143.

Figure 4B:
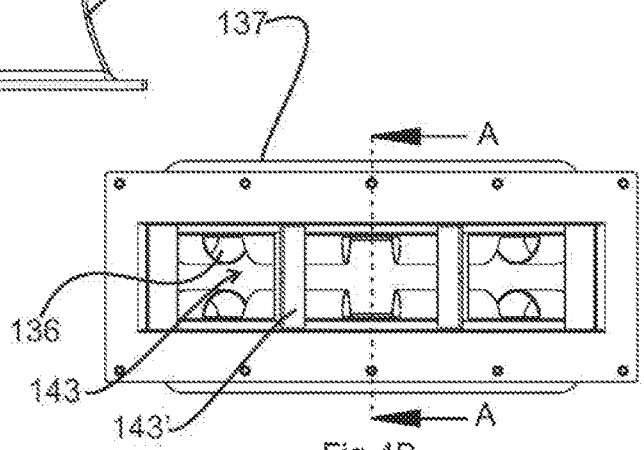
FIG. 4B is a front view of the PARM 135.

FIG. 4B is a front view of the PARM 135.

Figure 4C:
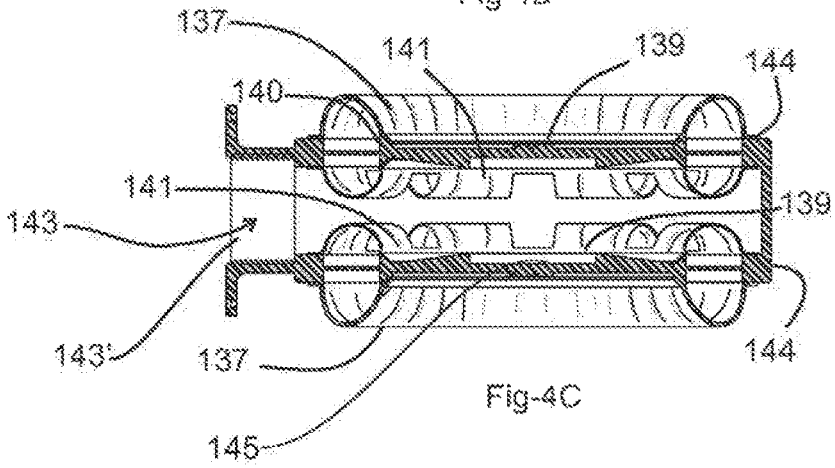
FIG. 4C is a section view of FIG. 4B along plane cut line A-A.

FIG. 4C is a section view of FIG. 4B along cut line A-A. There are open sections 136 (FIG. 4B) of the inner surround 141 that are cut out (absent) to optimize compliance and venting, precluding differential air pressurization between the outer the inner surround structures. The open sections 136 must be symmetrical and spaced equally around the perimeter of the surround 141. The thickness of the exterior frame wall 144 of the module to which the outer and inner surrounds 137, 141 are secured and suspend the central stiff cones 139 establish a defined peripheral mounting spacing (gap) between the outer and inner surrounds 137, 141.

Figure 4D:
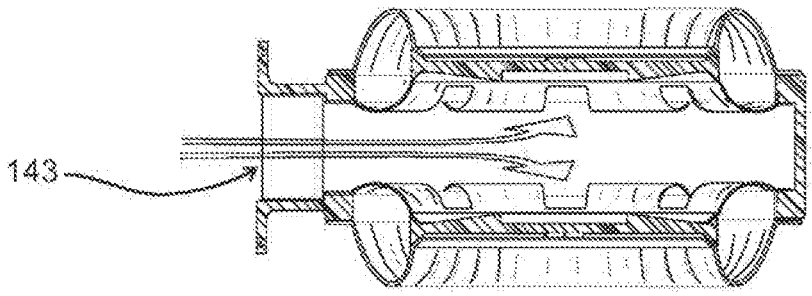
FIG. 4D shows the passive acoustic radiator module configuration offset from its balanced mid-position [PARM] during INHALE (portion of a vibration cycle).

FIG. 4D shows the passive acoustic radiator module configuration offset from its balanced mid-position [PARM] during INHALE (portion of a vibration cycle).

Figure 4E:
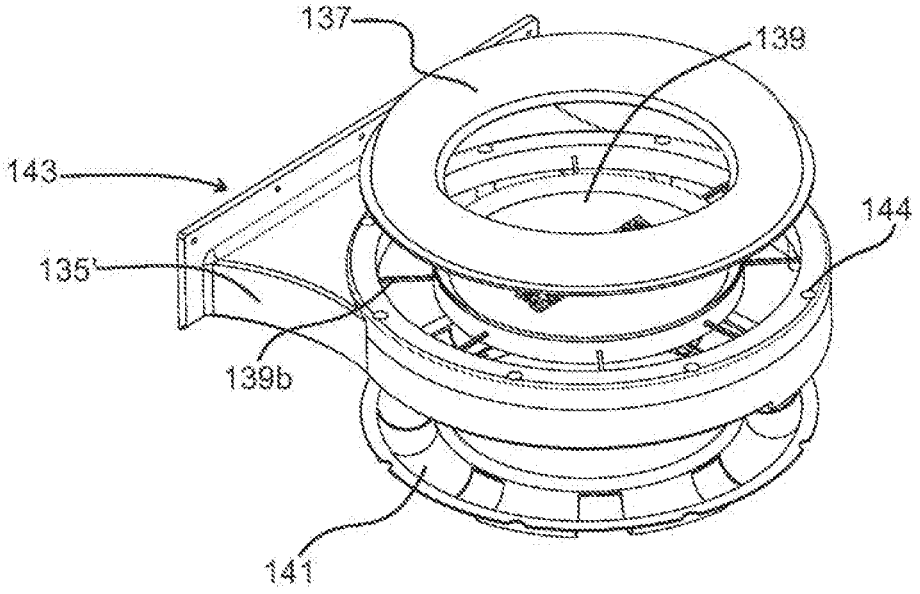
FIGS. 4E & 4F, respectively, present exploded views of top and bottom half assemblies of the PARM 135.
Figure 4F:
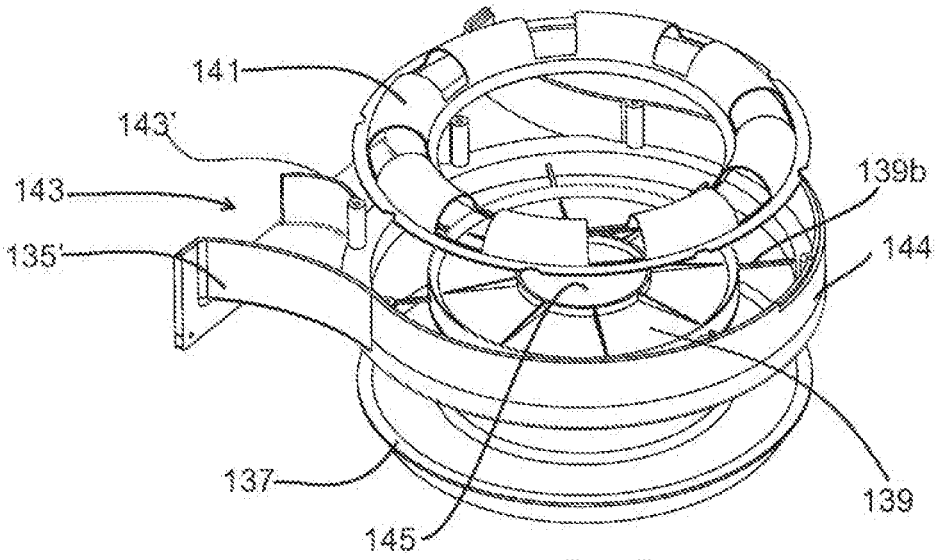

FIGS. 4E & 4F, respectively, present exploded views of top and bottom half assemblies of the PARM 135. Each comprises a mating plastic frame structure 135' that when joined form the PARM and together form a ported/cavity 143 or mouth opening to the outside. The peripheral mounting spacing between the outer and inner surrounds 137, 141 established by the thicker exterior frame wall 144 is chosen to reduce rocking and wobble. In both the top bottom assemblies eight plastic ribs 139*b* initially bridge between the frame wall 144 and the stiff cone structure 139 to keep the cone structure 139 centered during assembly. Once the outer surround 137 is secured between the stiff cone structure 139 and the exterior frame wall 144, the ribs 139*b* are removed.

Figure 4G:
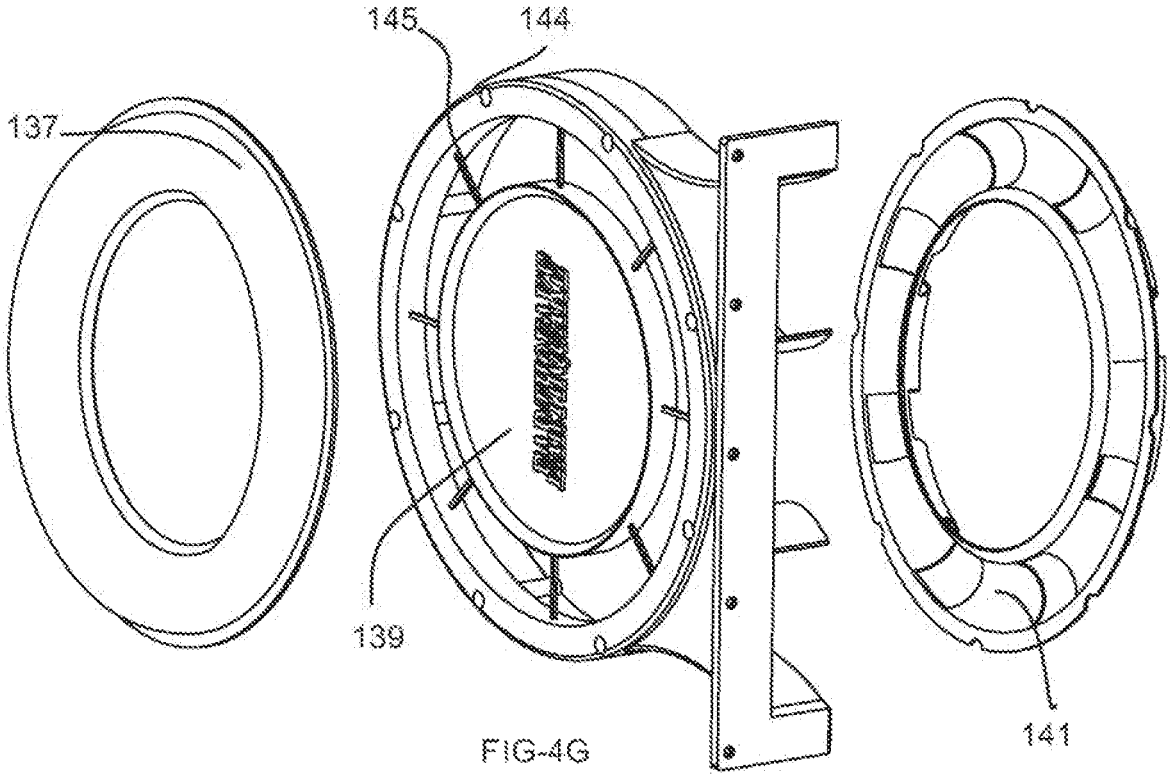
FIG. 4G is an exploded perspective view of the top or bottom assembly process of the PARM which are identical and mirror images of one another when assembled.
Figure 4H:
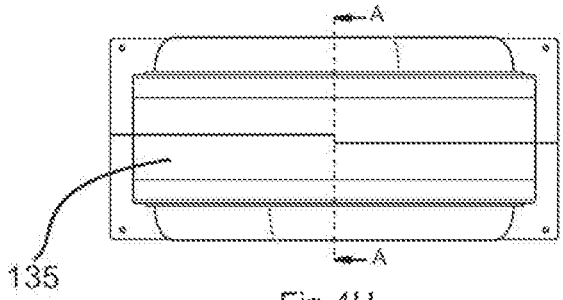
FIGS. 4H, 4J, 4K, and 4L shows outside end, cross sectional side, outside side, and cross sectional different perspective views of a design for a passive acoustic radiator module [PARM].

As illustrated in FIGS. 4C, 4F, and 4G the stiff cone 139 includes reinforcing ribs and a central recess 145 for accommodating a tuning mass (not shown). As configured, a PARM can be placed within an acoustic enclosure (speaker enclosure) by cutting a slot opening into the enclosure and inserting the PARM into the enclosure and securing the module extending into the enclosure anchored by the peripheral lip frame of the open mouth/port 143 of the PARM closing the slot. Substantially identical (often the differences are so small as to be considered negligible in the manufacturing practices of such devices) tuning masses are secured within each of the central recesses of 145 of the cone structures 139 for tuning the PARM to produce a desired frequency. Different tuning masses on the respective cone structures 139 of the respective passive radiators will tune them at two different frequencies. (Not recommended.)

FIG. 4G is an exploded perspective view of the top or bottom assembly of the PARM which are identical and mirror images of one another when assembled. The outer surround 137 has an inner annular lip that is coupled to the stiff cone structure 139 and an outer annular lip that is coupled to the top side the exterior frame wall 144. Once coupled the bridging ribs 144 are removed. Similarly the inner surround 141 has an inner annular lip that is coupled to the stiff cone structure 139 and an outer annular lip that is coupled to the bottom side of the exterior frame wall 144. Each assembly may have an added mass in the central recess 145 of the stiff cone structure 139 for accommodating a tuning mass for obtaining a desired tuning frequency. Typically the top and bottom passive acoustic radiator assemblies are tuned to the same frequency.

Figure 4J:
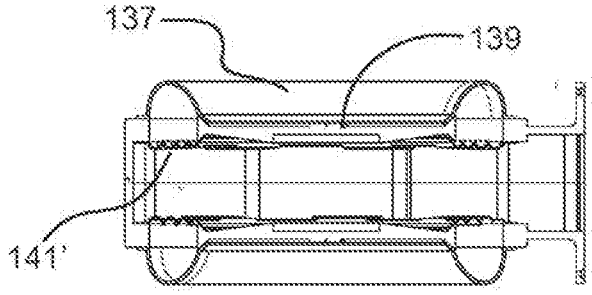
Figure 4K:
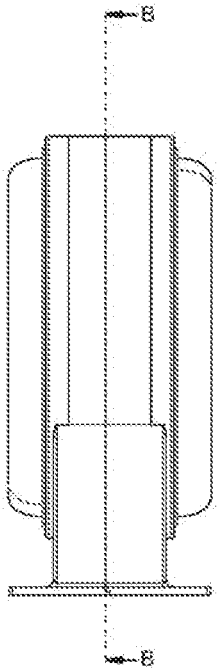
Figure 4L:
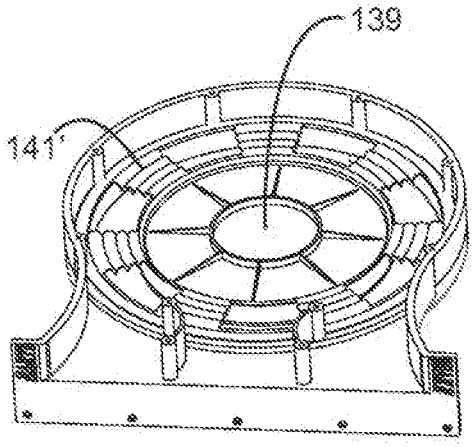

FIGS. 4H, 4J, 4K, and 4L show outside end, cross sectional side, outside side, and cross sectional perspective views of a passive acoustic radiator module [PARM]. FIG. 4L is a perspectives view of a cross sectional cut taken at line B-B of FIG. 4K. Low profile segmented spider (a concentric wave corrugated suspension—well known in the industry) 141' connecting between the inner edge of the outer frame opening and the outer edge of the stiff cone 139. The absent segments in the spider 141' allow air passage through the spider plane so that the stiff cone is sealed only by the outer surround 137. As can be seen in FIG. 4J the use of a spider suspension structure at the surfaces of the passive radiators reduces or eliminates the chance that any components of the two passive radiators position across the cavity from each other will have a mechanical interference (or touching) during maximum amplitude travel in a direction towards each other in operation.

Figure 5:
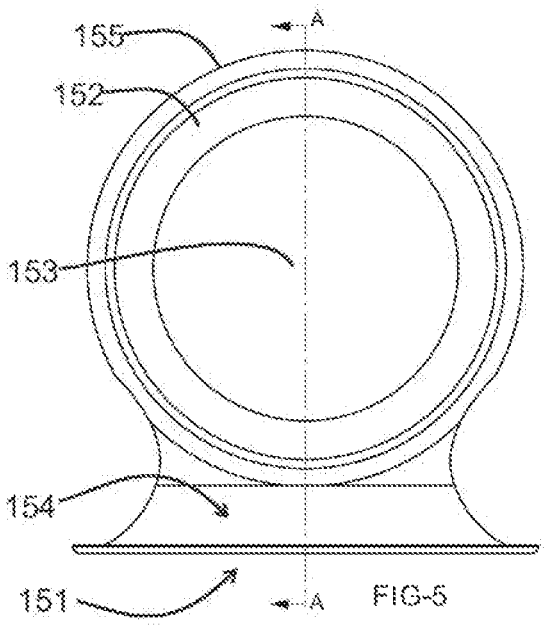
FIG. 5 shows a PARM with a cavity wall 155 with an open mouth/port 151.

FIG. 5 shows a PARM with a cavity wall 155 with an open mouth/port 151. There are two additional identical round openings where passive radiator elements are secured by a flexible annular suspension 152 for a top radiator (a stiff round disk 153 with a predetermined mass), that is suspended by the flexible suspension 152 within the (upper) round opening in the cavity wall 155 to provide a passive radiator with a predetermined mass. Finally the open mouth/port 151 has a variable cross-sectional area 154 whose constriction and shape can be changed in design or tuning to provide and adjust horn loading. The (lower) second round opening has the outer OD of suspension 152A connected to it, inner diameter of suspension 152A connects to the OD of disk 153A; this assembly creates a suspended mass referred to herein as a bottom passive radiator "A."

Figure 5A:
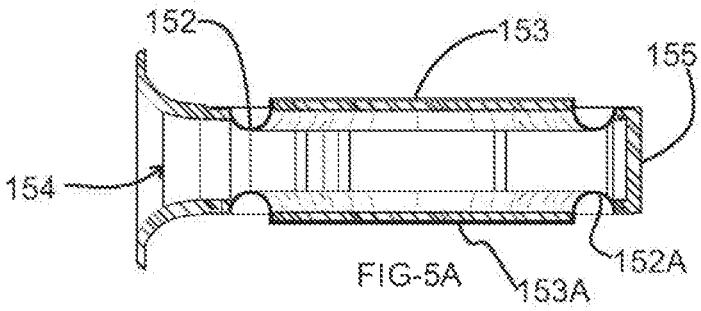
FIGS. 5A & and 5B shows a central cross-sections A-A of the PARM of FIG. 5 with two identical radiating surfaces each suspended by single suspension.
Figure 5B:
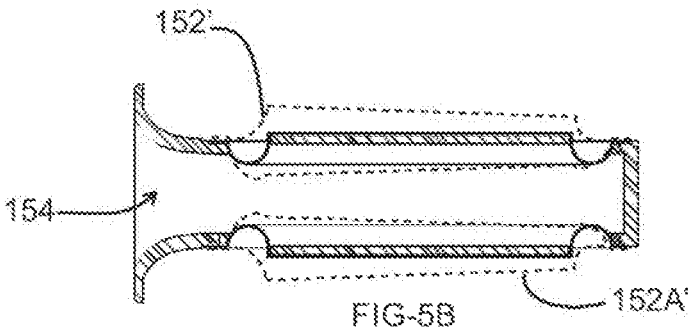

FIGS. 5A and 5B show a central cross-sections A-A of the PARM of FIG. 5 with two identical radiating surfaces each suspended by single suspension. Inertial air resistance within the PARM cavity increases as air moves in and out and within cavity. During the inhale and exhale the passive radiators excursions are of the suspended stiff cone structure tend to be greater proximate the open port/mouth 151 of the PARM as illustrated in FIG. 5B by dashed lines 152A'. This wobble not only cause frequency distortions but also audible wind noise to be dealt with. There are several ways to attempt to cancel this wobble in order to increase output amplitude and control (reduce) distortion.

Figure 6:
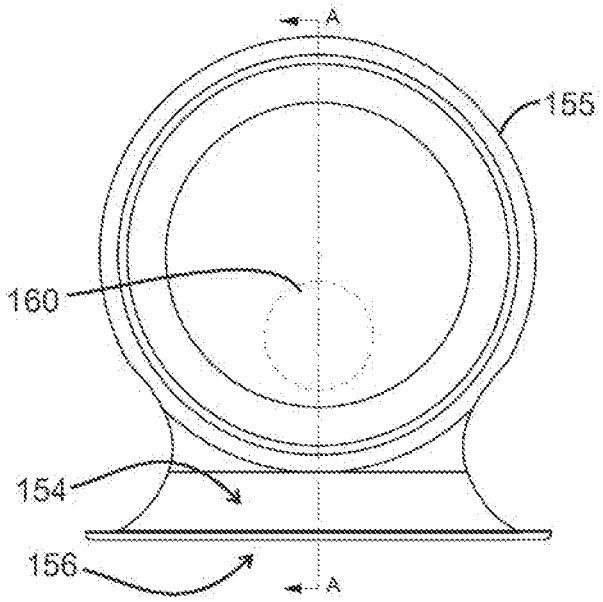
FIG. 6 shows a plan view of the passive radiator module with an offset tuning mass 160 that is equal to ½ air mass loading offset at or near the port/mouth opening along the center axis of the PARM.

FIG. 6 shows a plan view of the passive radiator module with an offset tuning mass 160 that is equal to ½ air mass loading offset at or near the port/mouth opening along the center axis of the PARM.

Figure 6A:
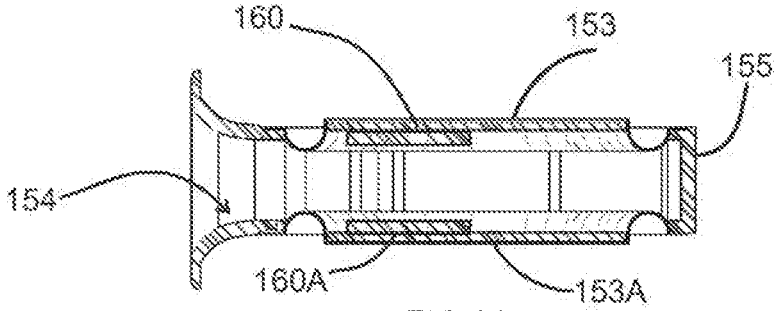
FIG. 6A is a cross sectional cut of FIG. 6 along the center axis at line A-A exposing offset mass 160 and 160A
Figure 6B:
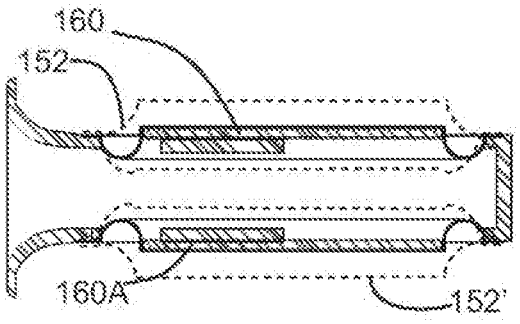
FIG. 6B shows a non-wobble linear excursion (dashed line 152') when utilizing a tuned mass in a PARM.

FIG. 6A is a cross sectional cut of FIG. 6 along the center axis at line A-A exposing offset mass 160 and 160A FIG. 6B shows a non-wobble linear excursion (dashed line 152') when utilizing a tuned mass in a PARM.

FIG. 6, 6A, 6B show a PARM that has one suspension per moving mass. Untuned, the flat moving passive radiator elements in this design wobble during long excursions. However securing tuning masses 160, centered with respect to the mouth axis of the PARM can reduce (damp) the wobble. Since there are two radiating surfaces, each has a tuning mass offset from the center of mass of the stiff disks of the passive radiator 153. These masses at least partially cancel the differential air mass loading on the front part of the radiating surface, slowing down the motion of the front part. In this embodiment, the surround is inverted decreasing the thickness of the PARM. This design shows an integral open mouth 154 providing horn loading for enhancing low frequency gains.

Figure 7:
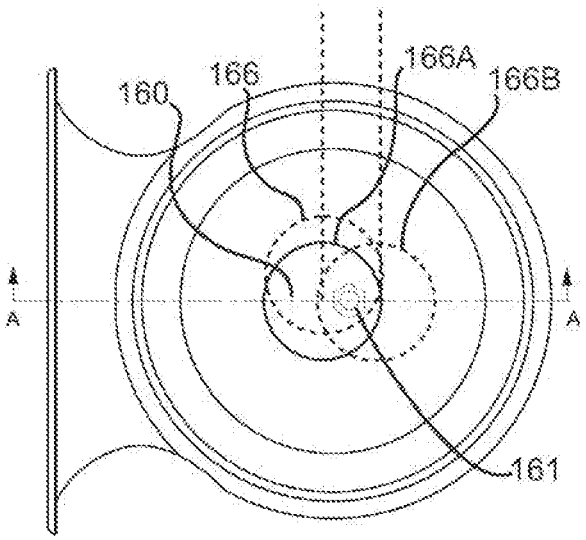
FIG. 7 is a plan view of a PARM showings a tuning mass 160 with a various variety of possible positions for the mounting offsets for to adjusting the center of mass of a passive radiator forward for to emulating emulate air mass loading encountered when driven by an active acoustic radiator speaker in an acoustic enclosure.

FIG. 7 in a plan view of a PARM showing a tuning mass 160 with a variety of possible positions for the mounting offsets to adjust the center of mass of a passive radiator forward to emulate air mass loading encountered when driven by an active acoustic radiator speaker in an acoustic enclosure. The tuning mass 160 is conventionally secured to at the various offset positions on the flat stiff disk of the passive, e.g. by a nut and bolt 161 off set from the center of the tuning mass 160.

Offset positions 166,166A, 166B are accomplished by simply rotating the tuning the mass 160 about the bolt 161 and tightening the nut.

Figure 7A:
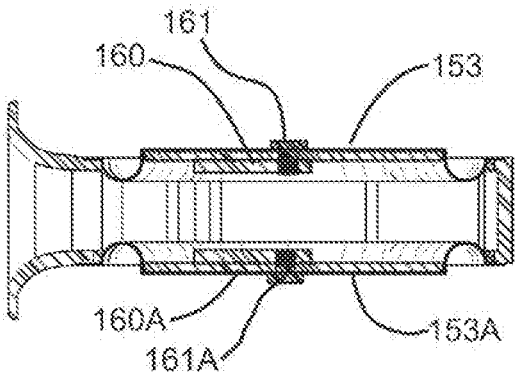
FIG. 7A is a side view cross sectional view across A-A showing the masses 160, 160A.

FIG. 7A is a side cross sectional view across A-A showing the masses 160, 160A 161; 161A are the mounting bolts that fasten offsetting the tuning mass to reduce wobble of the driven passive radiators of the PARM induced by air mass inhale/exhale through the mouth of the PARM. An acoustical designer can also position the tuning mass offset from a center position to alleviate wobble induced by other factors, e.g., as gravity when the PARM is angularly mounted. Gravity is a factor that affects the at rest position of a moving masses and the inertial loading of the respective passive radiators of PARMs.

Figure 8:
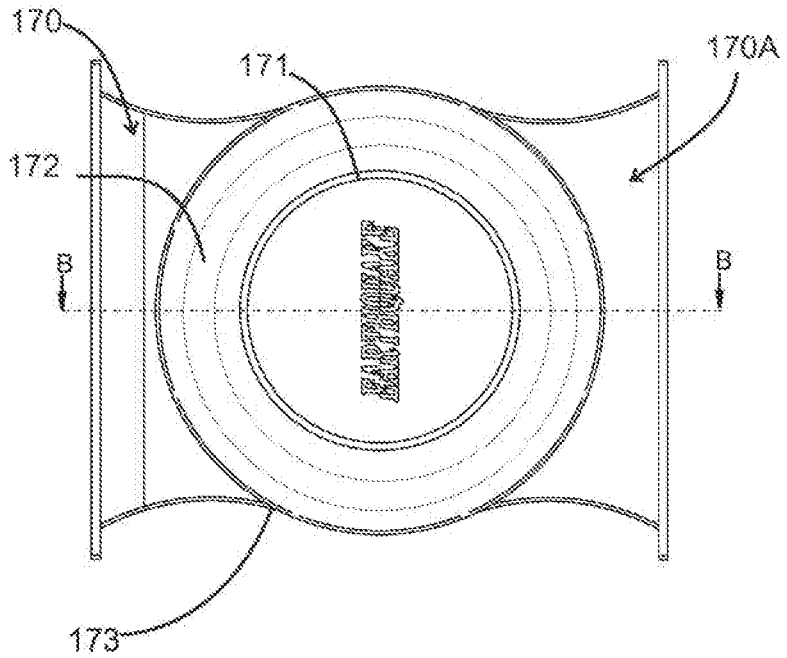
FIG. 8 shows PARM with opposite (through acoustic enclosure) radiation symmetrical horn loading port/mouths.

FIG. 8 shows PARM with opposite (through acoustic enclosure) radiation symmetrical horn loading port/mouths 170, 170A (open horn loading mouth 170; symmetrical horn loaded open mouth 170A; stiff flat disk 171, 171A; and flexible suspension 172 for the disk 171.

Figure 8A:
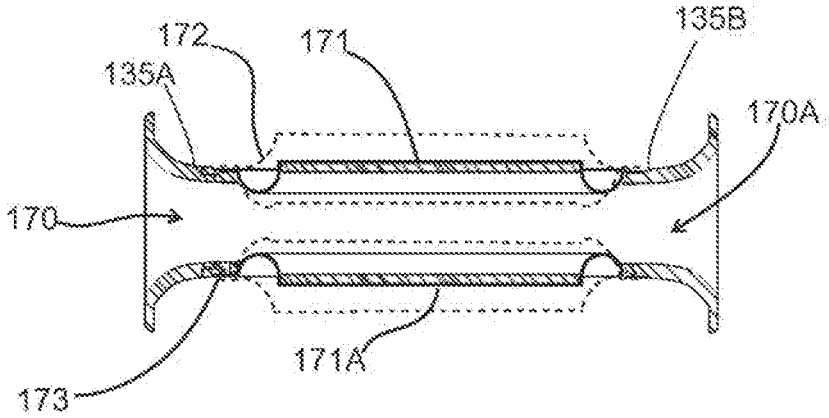
FIG. 8A is a cross-section view along B-B of FIG. 8 showing connecting ring 173.

FIG. 8A is a cross-section view along B-B of FIG. 8 showing connecting ring 173. This module represents two passive radiators that are symmetrically loaded as well as have two identical mouths (openings) 170,170A. These will radiate acoustic waves that resonate from the passive radiators. Due to the symmetry, the passive radiator will not wobble. The left mouth 170 will be glued after the passive module is mounted by screws located around 170A shows an optional cross-section that has connecting ring 173 for gluing the two pieces together.

Figure 9:
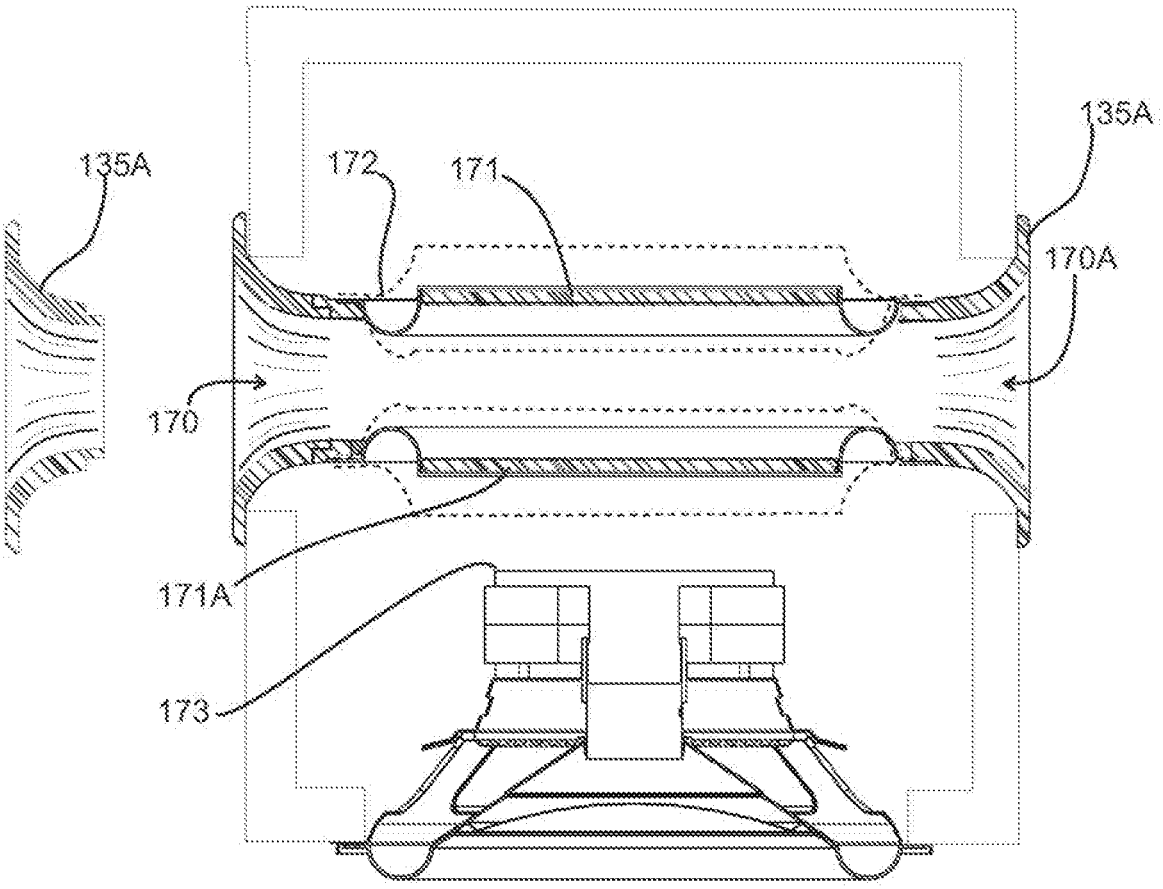
FIG. 9 is a cross sectional view illustrating components of and assembly steps for placing the PARM of in FIG. 8 in an acoustic enclosure.

FIG. 9 is a cross sectional view illustrating components of and assembly steps for placing the PARM of in FIG. 8 in an acoustic enclosure.

Figure 10:
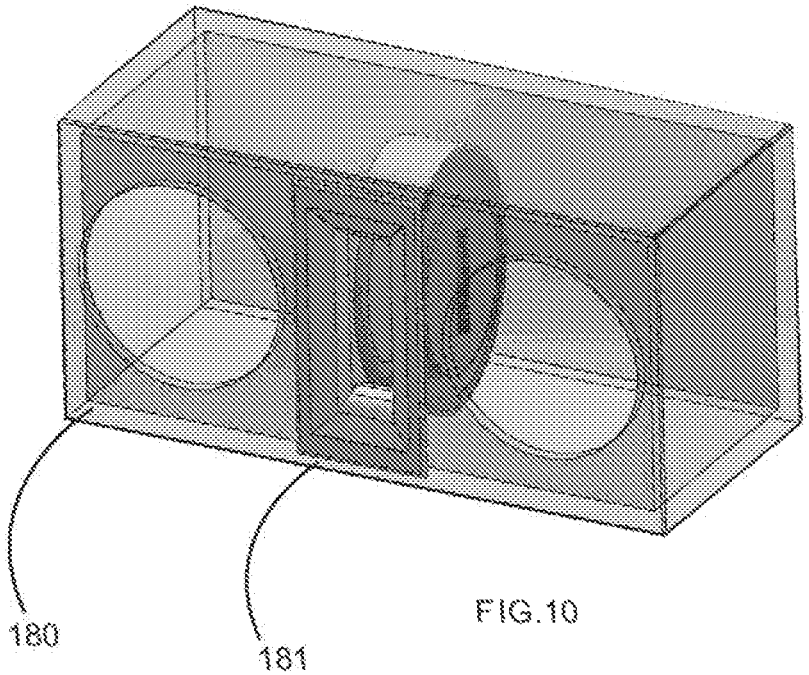
FIG. 10 is a partial see through perspective view showing an acoustic enclosure 180.

FIG. 10 is a partial see through perspective view showing an acoustic enclosure 180 for two speaker sand a PARM 181 mounted in the in enclosure 180. In this his acoustic arrangement the PARM radiates low mono frequencies while a pair of mounted active acoustic radiators (speakers) radiate full range stereophonically generated sound, commonly referred to as a 2.1 system. (The number 2 represents stereo two speakers and 0.1 represents the subwoofer range.)

Figure 11:
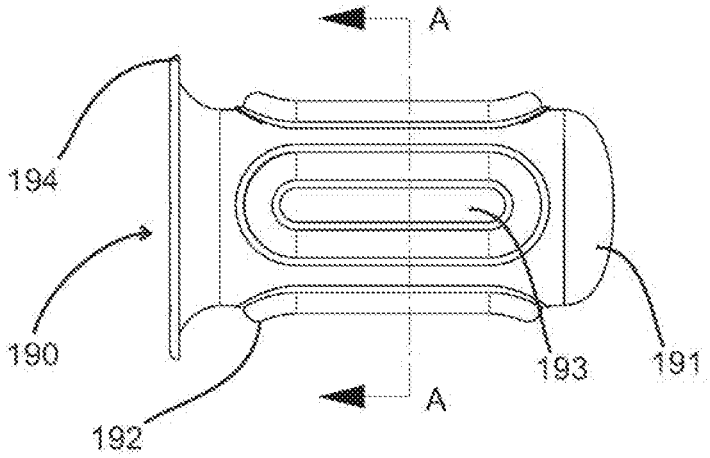
FIG. 11 is a side view of a tubular PARM having an open mouth 190 that opens to and radiates outside of an acoustic enclosure.

FIG. 11 is a side view of a tubular PARM including an open mouth 190 that opens to and radiates outside of an acoustic enclosure, having a closed back end 191 submerged within in the acoustic enclosure, flexible surround 192 of one of the radiating passive radiator, a stiff central radiating panel 193 of the passive radiator of the PARM, and mounting flange 194 for the PARM.

Figure 11A:
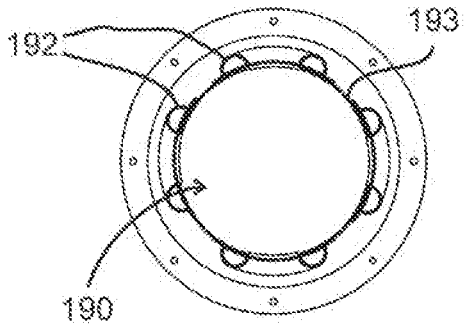
FIG. 11A shows a cutaway view along the A-A of the PARM showing in FIG. 11.

FIG. 11A shows a cutaway view along the A-A of the PARM showing in FIG. 11 including curved radiating panel surface 193, curved flexible surround 192 suspending the curved radiating panel surface 193.

Figure 11B:
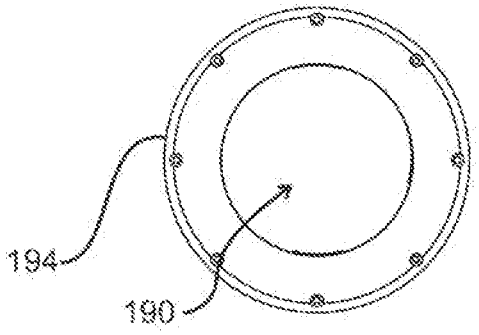
FIG. 11B is a front view of the tubular PARM of FIG. 11.

FIG. 11B is a front view of the tubular PARM of FIG. 11 including the open mouth 190 and mounting flange 194.

Figure 12:
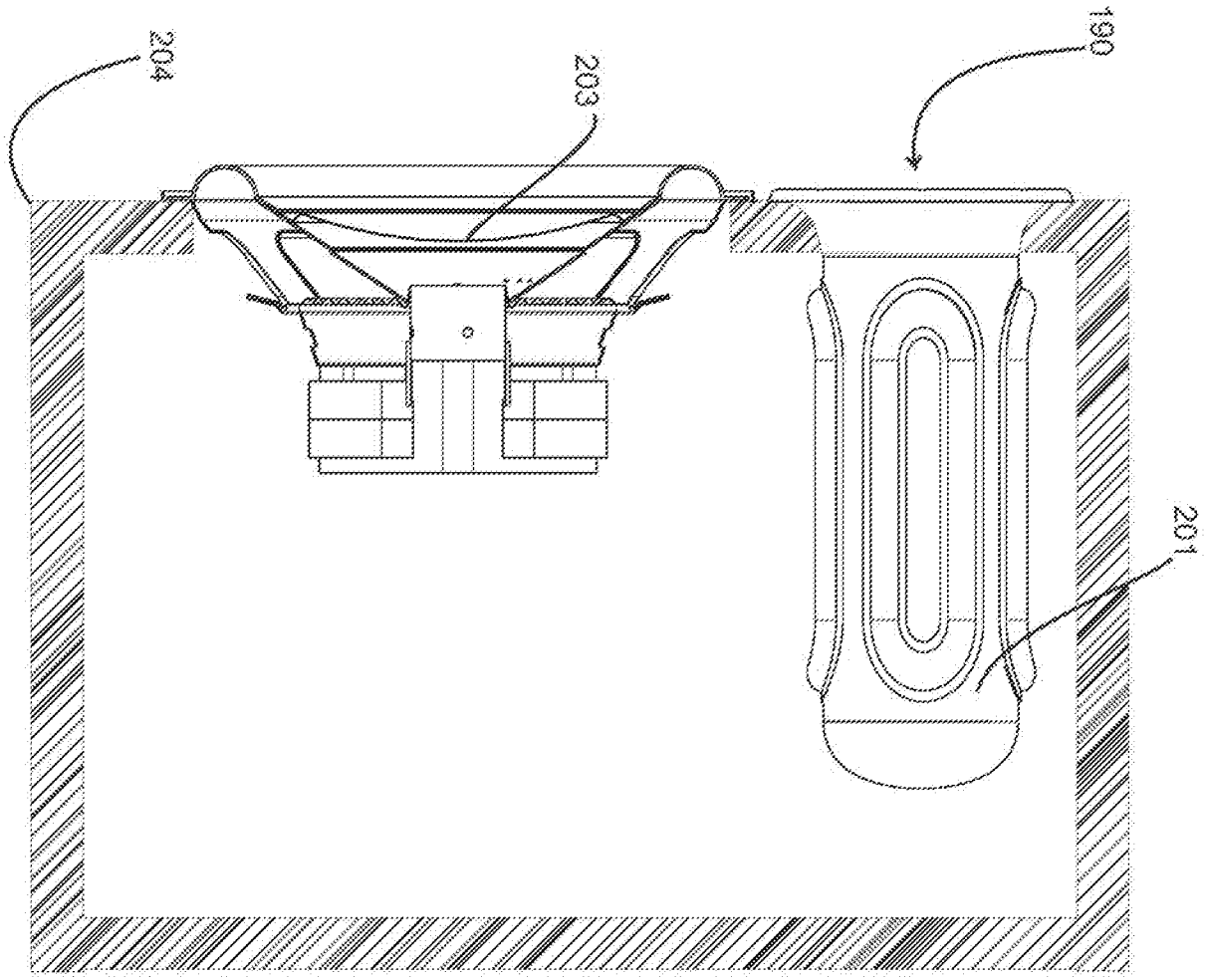
FIG. 12 is a cross sectional view of an acoustic enclosure showing the positioning of the PARM of FIG. 11 positioned therein.

FIG. 12 is a cross sectional view of an acoustic enclosure showing the positioning of a the PARM of FIG. 11 positioned therein, having a tubular passive module 201, open mouth 190 that can radiate the enclosure's sound pressure levels—from an active speaker 203 that is designed to radiate sound—within acoustic enclosure 204. Most vented enclosures that exist on the market today are tuned via a slot port (rectangular opening) or by a round tube. The tube is more common in home audio full range acoustic systems. The tube has a predetermined length and diameter will have a port tuning that is related to the box volume and the mass of air that is equal to the port volume. When tuning a one cubic foot box to 30 Hz, the length of a port needed significantly exceeds the one foot dimension of a cubic dimension box. This design offers the same size port but with added mass to achieve the same results while occupying less volume. The design shows an implementation of the tubular module design. The driving acoustic speaker 203 pressurizes and de-pressurizes the enclosure causing the walls of the passive to move in and out. The design objective is to have the PARM acoustically radiate in phase at selected frequencies of interest. Unlike conventional round ports, this design has a closed back providing internal pressure pushes against the walls of the tube leading to air movement in/out of the mouth of the open port/mouth of the PARM.

Figure 13:
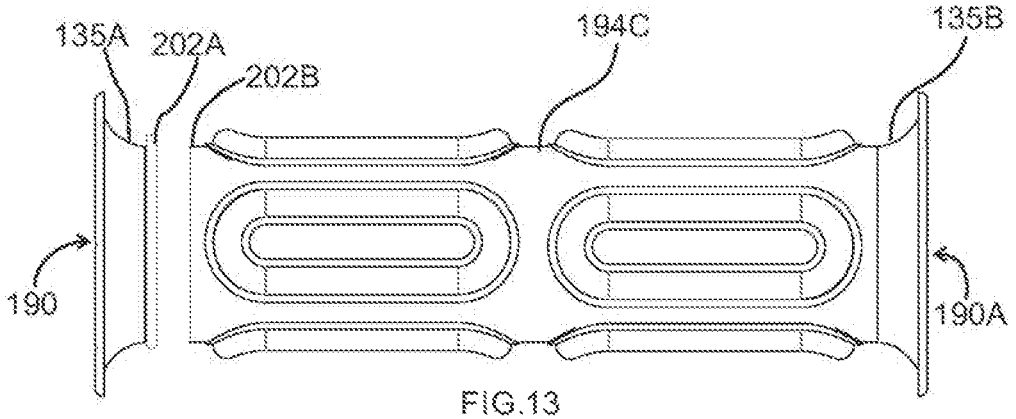
FIGS. 13 and 13A show a tubular PARM with opposing ports/mouths.
Figure 13A:
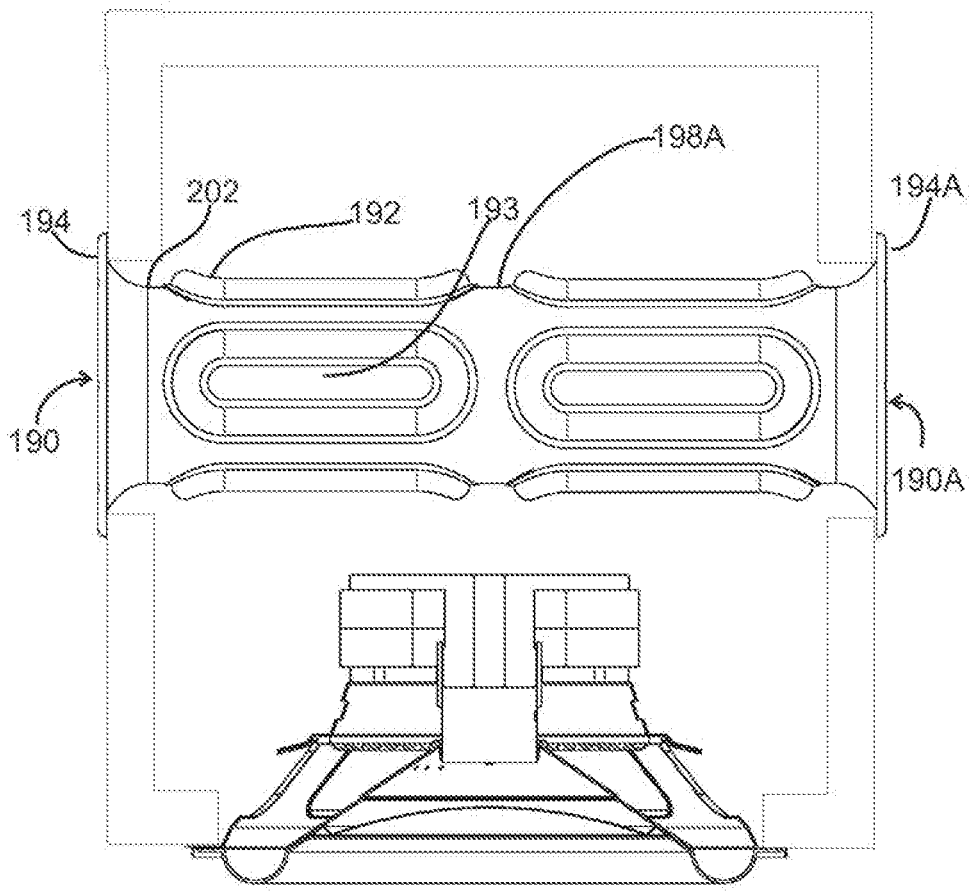

FIGS. 13 and 13A show a tubular PARM with opposing ports/mouths (through enclosure) having two mounting flanges 194, 194A that are secured to opposite walls of an acoustic enclosure for mounting the PARM within the enclosure, including an open mouth flange 190A open end tube part 2 190B and passive radiator part 1 194C. These opposing mouths allows for the air to move in and out of the port. This method allows for symmetrical loading but does not solve the wobble problem. Anti-wobble tuning masses are necessary to stabilize each and every radiating surface.

FIG. 13A shows a cross section of an acoustic enclosure illustrating the assembly method of the port module 198A into an enclosure. First passive radiator part 1 194C is mounted into the enclosure, thereafter open end tube part 2 194B is mounted on the opposite surface by gluing mounting flange 190A to open end tube part 2 190B thus leading to PARM with two opposing mouths.

Figure 14:
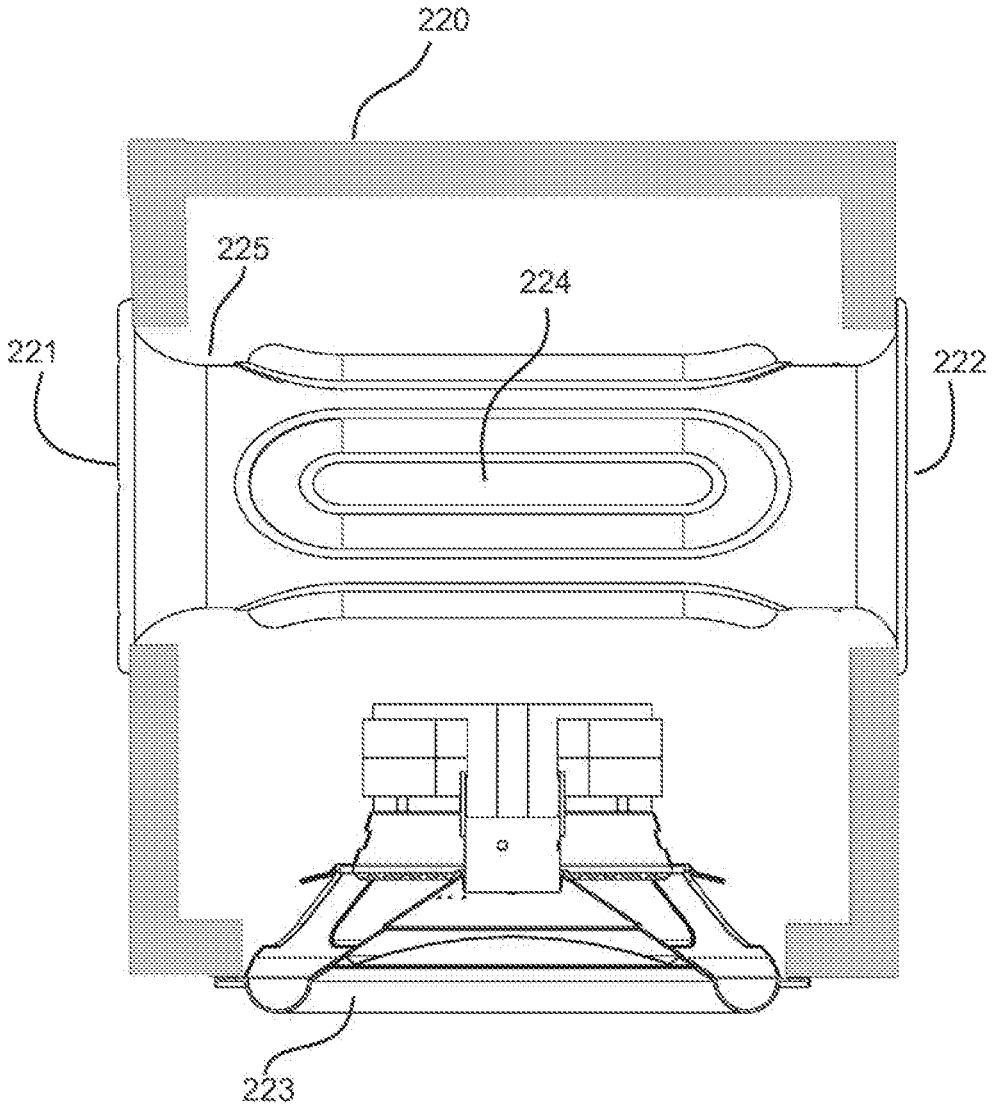
FIG. 14 illustrates a tubular PARM that has two open mouths that are symmetrically loaded.

FIG. 14 illustrates a tubular PARM that has two open mouths that are symmetrically loaded. A vibratory element (diaphragm), e.g., 224, faces an equal resistance to the outside pressure therefore there is no wobble and no need to provide an anti-wobble mass. This design optimizes symmetry in order to minimize wobble. The tubular PARM has opposing ports/mouths 221, 222 (through enclosure) having two mounting flanges (surrounding the mouths) that are secured to opposite walls of an acoustic enclosure for mounting the PARM within the enclosure. These opposing mouths allows for the air to move in and out of the tubular body of the PARM The open mouths 221, 222, are at the end of a tubular body end piece. Where at least at one end the end piece and main body are connected at a mating line 225. The mating line 225 illustrates a connection joint along which connection between the inner tube and the outer tube (end piece) extension with flanges are joined within the enclosure 220 containing a plurality of radiating stiff surfaces, e.g., 224, and speaker 223.

Figure 15:
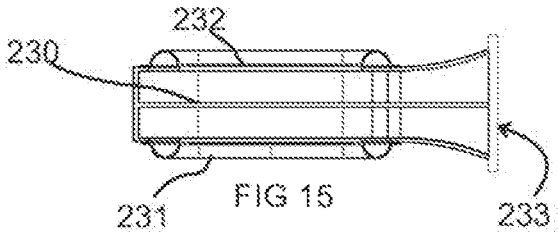
FIG. 15 shows a cross section of a rectangular (or square) passive radiator including FIG. 15A which is a 3D module view with front prospective perspective view of the radiator of FIG. 14.
Figure 15A:
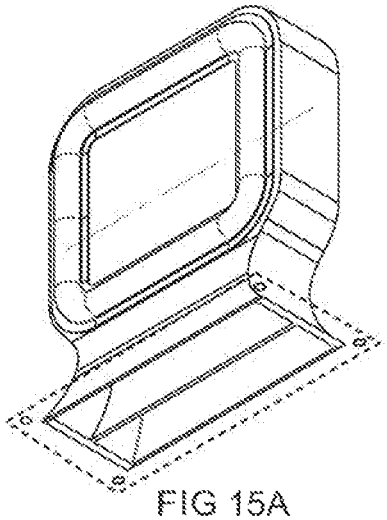
FIG. 15B is a top view of the module of FIG. 15 showing a horn loaded passive radiator with a rectangular suspended surface.
Figure 15B:
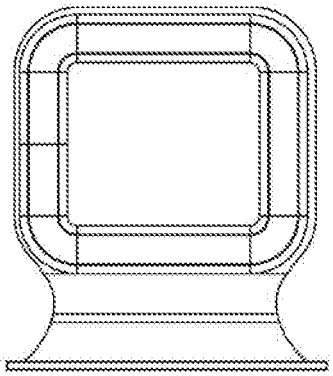

FIG. 15 shows a cross section of a rectangular (or square) passive radiator including a rectangular radiating surface 232, radiating rectangular surface 231, a surface (inside wall) 230 that isolates the pressure developed by rectangular radiating surface 231 from impacting the surface of rectangular radiating surface 232, an open mouth 233 that is surrounded by a mounting flange. FIG. 15A this is a front perspective view of the radiator of FIG. 14. FIG. 15B is a top view of the module of FIG. 15 showing a horn loaded passive radiator with a rectangular suspended surface.

The passive module shown in FIGS. 14, 14A, and 14B has a rectangular radiating surface that increases the radiating area by 23% relative to similarly laterally dimensioned circular radiating area. Furthermore, this design offers a separating surface (wall) between the two radiating diaphragms so that there will be no phase shift. Another benefit of this design is to be able to use horn loading as a radiating frequency tuning tool to improve low frequency sound (frequency extensions).

Figure 16:
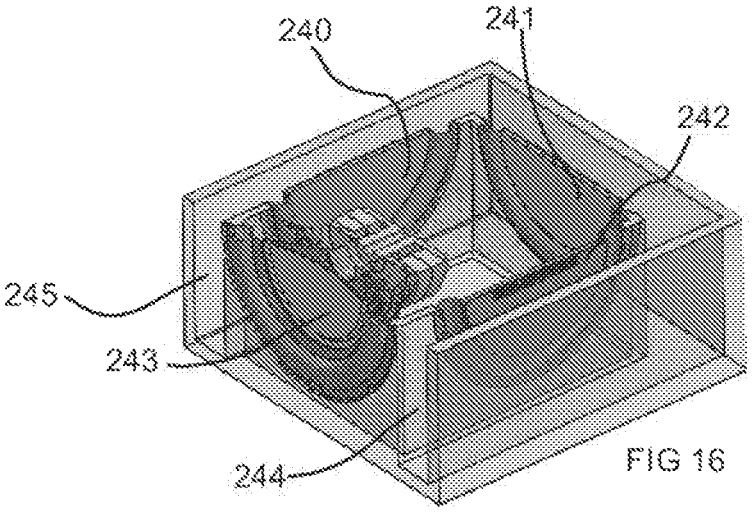
FIG. 16 is a lateral cross sectional perspective view of a sealed speaker enclosure surrounded by and spaced from an outer enclosure wall.

FIG. 16 is a lateral cross sectional perspective view of a sealed speaker enclosure surrounded by and spaced from an outer enclosure wall. An active speaker 243 is shown mounted in a front surface of the cube-like sealed speaker enclosure. Passive radiators 240, 241, 242 are mounted in the two side and one back wall of the sealed speaker enclosure. Open mouth vents 244, 245 one to the front of the structure providing a port from the outside surface of the sealed speaker enclosure and the inside surface of the outer enclosure wall.

Figure 17:
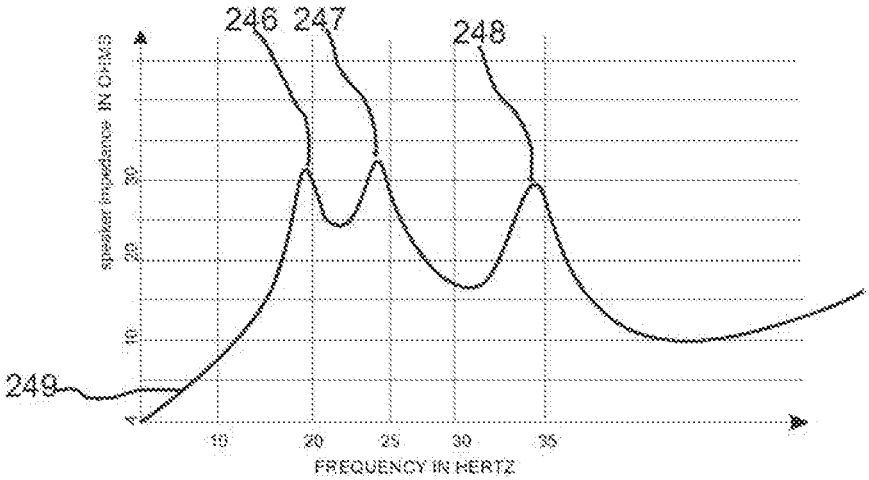
FIG. 17 shows an impedance versus frequency response plot 249 of the speaker box shown in FIG. 16.

FIG. 17 shows an impedance versus frequency response plot 249 of the speaker box shown in FIG. 16. Impedance peaks 246, 247, are identified as originating from passive radiators 240, 242 (substantially identical) and passive radiator 241, respectively. Impedance peak 248 is attributable to active speaker 243. The arrangement shown in FIG. 16 shows three passive radiators 240, 241, 242 radiating into a channel type port with two open end mouths 244, 245. This design offers a massive large surface area. Sound pressure levels originating with passive radiator 241, which in this instance can be identified as a rear wave against the surrounding surfaces most of which are moving. Not only do the passive radiators in this configuration get charged (displaced) by the air spring due to pressure changes. This configuration of passive radiators tends to reduce rear wave reflections that is generated by the active speaker 243 and thus leads to less cone distortion.

The plot 249 demonstrates the fact that the peak impedances 246, 247 are detected at different frequency values. The design of FIG. 16 requires tuning as follows: 1st a mass should be added to the vibrating elements of passive radiators 240, 242 to remove wobble. This can be done as previously discussed. Secondly, a tuning mass should be added to the vibrating elements of passive radiator 241 so that its impedance peak frequency 247 is moved down to 246. This can be done by adding mass to the middle of the radiating surface. There is no need to add anti wobble mass to 241.

Figure 18:
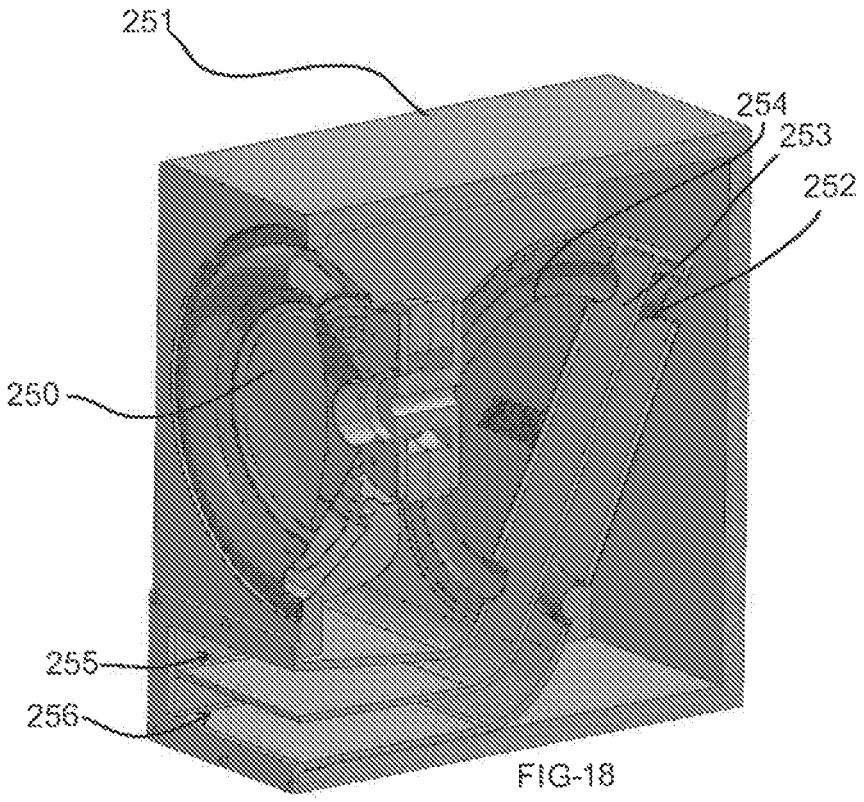
FIG. 18 is a cross sectional perspective view of an acoustic enclosure 251, active speaker 250, open end radiating mouths 255, 256, passive radiator surface 254, passive radiator surface 252, and separate plane 253.

FIG. 18 is a cross sectional perspective view of an acoustic enclosure 251, active speaker 250, open end radiating mouths 255, 256, passive radiator surface 254, passive radiator surface 252, and separate plane 253.

FIG. 18 shows a cutaway of an enclosure 251 which has a speaker 250 radiating and loading a passive module which has inner and outer surfaces 254 and 252, respectively. These surfaces are isolated from one another by a separation plane 253 which isolates or blocks phase shifts generated by non-uniformity in manufacturing as well as one sided sound pressure loading creating a wobble. Use of an anti-wobble mass is necessary to stabilize the vibrating surfaces of the passive radiating elements. A further benefit of the arrangement shown in FIG. 18 is the slanted "L" shape of the passive loading module. In this configuration, the passive radiator element mounted in the inner surface 254 facing the rear of the active speaker 250, directly receives, dampens and reflects directly the sound pressure received from the back of the active speaker 250. This arrangement reduces frequency phase distortion which occurs in other configurations where the sound pressure waves must bounce off and reflect off angled and side surfaces.

While the invention has been described With regard to specific embodiments, those skilled in the art will recognize that changes can be made in form and detail without departing from the spirit and scope of the invention.

The invention claimed is:

1. A passive acoustic radiator module capable of being installed into an acoustic speaker enclosure, wherein said passive acoustic radiator module comprises: a tubular element having a mouth at one end and closed at an end opposite said mouth, wherein one or more passive acoustic radiating surfaces are suspended in one or more sidewalls of said tubular element.

2. The acoustic radiator module as in claim in 1, wherein a center of gravity of a moving mass of said radiating surfaces are offset from their dimensional centers along the a central axis of said tubular element towards said mouth.

3. The acoustic radiator module as in claim in 3 wherein the space between a smallest constrict area of said mouth and the radiating surfaces defines a horn loaded volume.

4. The acoustic radiator module as in claim 3, where a mounting flange surrounds said mouth to support and seal said acoustic radiator module in an opening of a surface.

5. The acoustic radiator module as in claim 2, where a mounting flange surrounds said mouth to support and seal said acoustic radiator module in an opening of a surface.

6. The passive acoustic radiator module of claim 2, wherein a cross-section of the tubular element is elliptical or rectangular or triangular.

7. The passive acoustic radiator module of claim 1, wherein said tubular element is curved.

8. The passive acoustic radiator module of claim 1, wherein said tubular element is curved and has a predetermined length.

9. The passive acoustic radiator module of claim 1, wherein a cross-section of the tubular element is elliptical or rectangular or triangular.

10. A passive acoustic radiator module capable of being installed into an acoustic speaker enclosure, wherein said passive acoustic radiator module comprises: a tubular element open at both ends, wherein one or more passive acoustic radiating surfaces are suspended in one or more sidewalls of said tubular element symmetrically positioned equidistant from both ends of said tubular element.

11. The passive acoustic radiator module of claim 10, wherein said tubular element is curved.

12. The passive acoustic radiator module of claim 10, wherein said tubular element is curved and has a predetermined length.

13. The passive acoustic radiator module of claim 10, wherein a cross-section of the tubular element is elliptical or rectangular or triangular.

14. In an acoustic enclosure having an active acoustic radiator, capable of radiating variable acoustic pressure pulses within the acoustic enclosure, an improvement comprising, in combination therewith: a tubular passive radiator module having a ported cavity supported within the acoustic enclosure; a substantially matched pair of passive radiators symmetrically oriented to and supported on opposing side walls of said tubular ported cavity each having a predetermined mass distribution that induces the pair of passive radiators to symmetrically vibrate responsive to variable acoustic pressure pulses when radiated by said active acoustic radiator within the acoustic enclosure.

15. The acoustic enclosure of claim 14, wherein said tubular ported cavity includes a horn to act a source from which a series of radiated variable pressure pulses directed outside the acoustic enclosure emanate.

16. The passive radiator module of claim 14, wherein said cavity is contained within a tubular structure extending into the acoustic enclosure having a closed hemispherical end within the acoustic enclosure and an open end adapted for mounting on, sealed to, and communicating through a wall of the acoustic enclosure.

17. The passive radiator module of claim 16, wherein the tubular cavity is cylindrical.

18. The passive radiator module of claim 16 wherein the tubular cavity is hexahedral.

* * * * *